US005938580A

United States Patent [19]

Siekmann

[11] Patent Number: 5,938,580

[45] **Date of Patent: *Aug. 17, 1999**

[54] CUSHIONING CONVERSION MACHINE WITH RESTRICTED ACCESS TO A CUTTING ASSEMBLY

[75] Inventor: Dirk Johannes Siekmann, Sittard, Netherlands

[73] Assignee: Ranpak Corp., Painesville, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,603

[22] PCT Filed: Apr. 14, 1995

[86] PCT No.: PCT/US95/04607

§ 371 Date: Oct. 15, 1996

§ 102(e) Date: Oct. 15, 1996

[87] PCT Pub. No.: WO95/28276

PCT Pub. Date: Oct. 26, 1995

[30] Foreign Application Priority Data

Apr. 15, 1994 [NL] Netherlands ..... 9400606

[51] Int. Cl.[6] ..... B31D 5/00

[52] U.S. Cl. ..... 493/38; 83/397; 83/860; 83/DIG. 1; 493/22; 493/464; 493/967

[58] Field of Search ..... 198/358; 493/464, 493/967, 22, 25, 27, 29, 30, 33, 38; 83/61, DIG. 1, 860, 397, 398

[56] References Cited

U.S. PATENT DOCUMENTS

| | | | |
|---|---|---|---|
| 3,888,148 | 6/1975 | Weissman | 83/397 |
| 4,074,602 | 2/1978 | Brower | 83/DIG. 1 |
| 4,088,856 | 5/1978 | Tebben | 83/DIG. 1 |
| 4,123,959 | 11/1978 | Schill | 83/DIG. 1 |
| 4,318,324 | 3/1982 | Hall | 83/397 |
| 4,424,741 | 1/1984 | Moldestad | 83/397 |
| 4,524,657 | 6/1985 | Griffith | 83/DIG. 1 |
| 4,528,488 | 7/1985 | Susemihl | 83/DIG. 1 |
| 4,536,144 | 8/1985 | Hehl | 425/154 |
| 4,619,635 | 10/1986 | Ottaviano | 493/36 |
| 4,761,901 | 8/1988 | Szafarz | 37/262 |
| 4,884,999 | 12/1989 | Baldacci | 493/439 |
| 5,241,885 | 9/1993 | Kuchler | 83/397 |
| 5,435,218 | 7/1995 | Martin | 83/860 |
| 5,442,983 | 8/1995 | D'Angelo . | |
| 5,538,490 | 7/1996 | Taniwa | 493/397 |

FOREIGN PATENT DOCUMENTS 3421 216 6/1984 Germany .

*Primary Examiner*—James F. Coan
*Attorney, Agent, or Firm*—Renner, Otto, Boisselle & Sklar, P.L.L.

[57] ABSTRACT

A machine for manufacturing a cushioning product starting from a multi-ply stock (R) material or the like includes a frame (12) having a housing (14) with an exit opening, a stock supply supported by the frame, a forming assembly (28) causing the lateral edges of the stock material to roll inwardly to form a continuous strip (36) having lateral pillow-like portions and a central band, a gear assembly (34) for feeding the stock material through the forming assembly and out the exit opening, a cutting assembly (26) intermediate the gear assembly and the exit opening for cutting a determined length of the continuous strip to produce a cushioning product and, an access assembly (46) for permitting the cushioning product to be fed therethrough and inhibiting access to the cutting assembly from outside the housing.

15 Claims, 4 Drawing Sheets

CUSHIONING CONVERSION MACHINE WITH RESTRICTED ACCESS TO A CUTTING ASSEMBLY

FIELD OF THE INVENTION

This invention relates generally to a dunnage-creating machine such as a cushion producing machine for producing a dunnage product from sheet-like stock material supplied, for example, in roll form and, more particularly, to an assembly for such a machine which inhibits foreign objects from entering the cutting zone of the machine.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. One machine which converts paper into a packaging material includes a stock supply assembly, a forming assembly, a gear assembly, and a cutting assembly, all of which are mounted on the machine's frame. During operation of such a cushion producing machine, the stock supply assembly supplies the stock material to the forming assembly. The forming assembly causes the lateral edges of the sheet-like stock material to roll inwardly to form a continuous strip having lateral pillow-like portions and a thin central band. The gear assembly pulls the stock material through the machine and also coins the central band of the continuous strip to form a coined strip. The coined strip travels downstream to the cutting assembly which cuts the coined strip into pads of a desired length.

Various attempts have been made to inhibit access to the cutting assembly of a cushioning conversion machine. For example, a cushioning conversion machine has been provided with a solid cover which remained in a closed condition unless physically pushed upon by a dunnage strip travelling through the exit opening. A modified version of this solid cover was a "curtain cover" formed from a plurality of fingers that were hinged to the machine in such a manner that they could be pushed outward by the approaching dunnage strip, but could not be pushed inward. However, either cover could be easily pulled open from the outside of the machine. Moreover, operation of the cutting assembly was completely independent from the condition of the cover, whereby the cutting assembly would continue to operate even when the cover was pulled open.

Another attempt made to inhibit access to the cutting assembly involved providing a cushioning conversion machine with a significantly long output chute that, by virtue of its length, would inhibit access to the cutting assembly. However, such an output chute added to the overall length of the machine, a disadvantage in the many packaging sites with limited space options. Also, such a long output chute complicated the discharge of shorter pads (i.e., pads shorter than the length of the chute). Moreover, operation of the cutting assembly was completely independent of the output chute whereby the cutting assembly would continue to operate even if a length foreign object was inserted into the output chute.

SUMMARY OF THE INVENTION

The present invention provides a cushion producing machine employing an access assembly downstream of the cutting assembly which is preferably open during the formation of a cushion and is closed prior to the initiation of a cutting process to inhibit access to the cutting assembly. Preferably, the machine is provided with a sensor which senses whether the access assembly is in an open or closed condition and which permits control of the cutting operation so that a cutting operation can only take place when the access assembly is in a closed condition. The access assembly may include a pair of flaps or valves, the positions of which are controllable so as to effectuate open and closed or semi-closed conditions or states for the access assembly. In accordance with the invention the access assembly is arranged in the exit opening of the machine and is controlled in time-dependent relation wit the actuation of the cutting assembly. The access assembly can herein be arranged in close proximity to the cutting assembly so that the machine housing can be considerably reduced in size over machines which depend on a relatively long discharge path downstream of the cutting assembly to inhibit the entry of a foreign object into the cutting zone of the cutting assembly. In accordance with one aspect of the invention, a machine for manufacturing a cushion product starting from a multiply stock material or the like includes a frame having a housing with an exit opening, a stock supply supported by the flame, a forming assembly causing the lateral edges of the stock material to roll inwardly to form a continuous strip having lateral pillow-like portions and a central band, a gear assembly for feeding the stock material through the forming assembly and out the exit opening, a cutting assembly intermediate the gear assembly and the exit opening for cutting a determined length of the continuous strip to produce a cushioning product and, an access assembly for permitting the cushioning product to be fed therethrough and inhibiting access to the cutting assembly from outside the housing.

In one preferred embodiment the access assembly includes at least one swiveling valve in the exit opening movable by a drive member.

According to a further embodiment, two swiveling valves are arranged in the exit opening for movement toward and away from each other, wherein the swiveling valves are moved synchronously by a joint coupling mechanism from the opened to the closed position.

These and other features of the invention are fully described and particularly pointed out in the claims. The following descriptive annexed drawings set forth in detail one illustrative embodiment, this embodiment being indicative of but one of the various ways in which the principles of the invention may be employed.

DETAILED DESCRIPTION OF THE INVENTION

Figure 1:
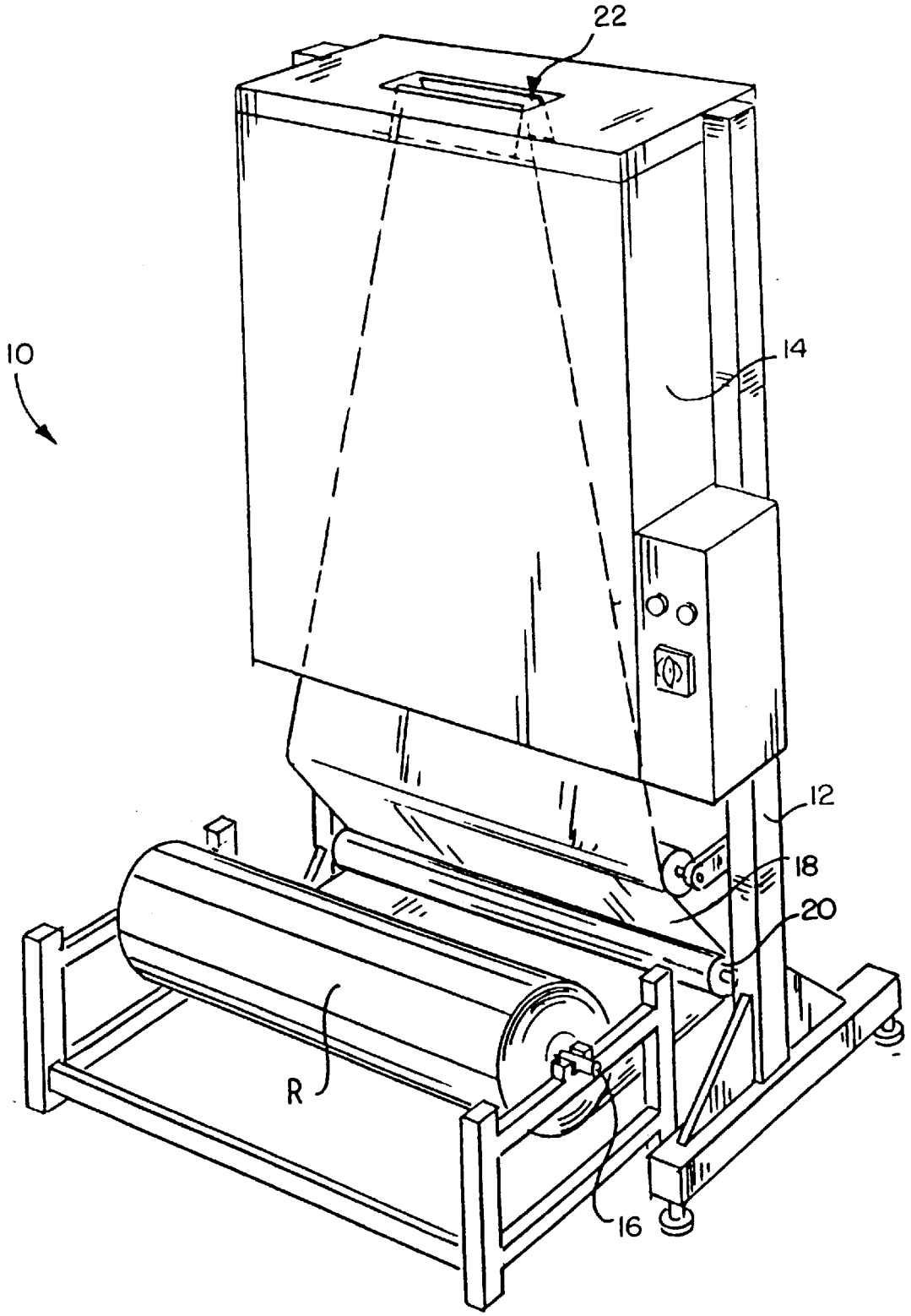
FIG. 1 shows a perspective standing view of an embodiment of the device according to the invention.

With reference to the drawings and initially to FIG. 1, there is shown a cushion producing machine 10 which includes a frame 12 with a housing 14 arranged thereon which comprises a number of processing assemblies discussed more fully below for converting sheet-like stock material into a cushioning product. It is noted that the illustrated embodiment of the frame 12 and the housing 14 is exemplary and that the frame and housing as well as other components of the machine 10 can be adapted to the particular place in which the machine will operate. In the illustrated embodiment the frame 12 is constructed from a number of profiles for support of the several components of the machine 10 including a rod 16 which supports a roll R of sheet-like stock material, such as Kraft paper. The paper 18 is unwound from the roll R and carried via reversing rollers 20 to the open underside of housing 14. The strip of paper 18 undergoes a conversion operation in the housing 14 and is discharged through the exit opening 22 in the top of housing.

Figure 2:
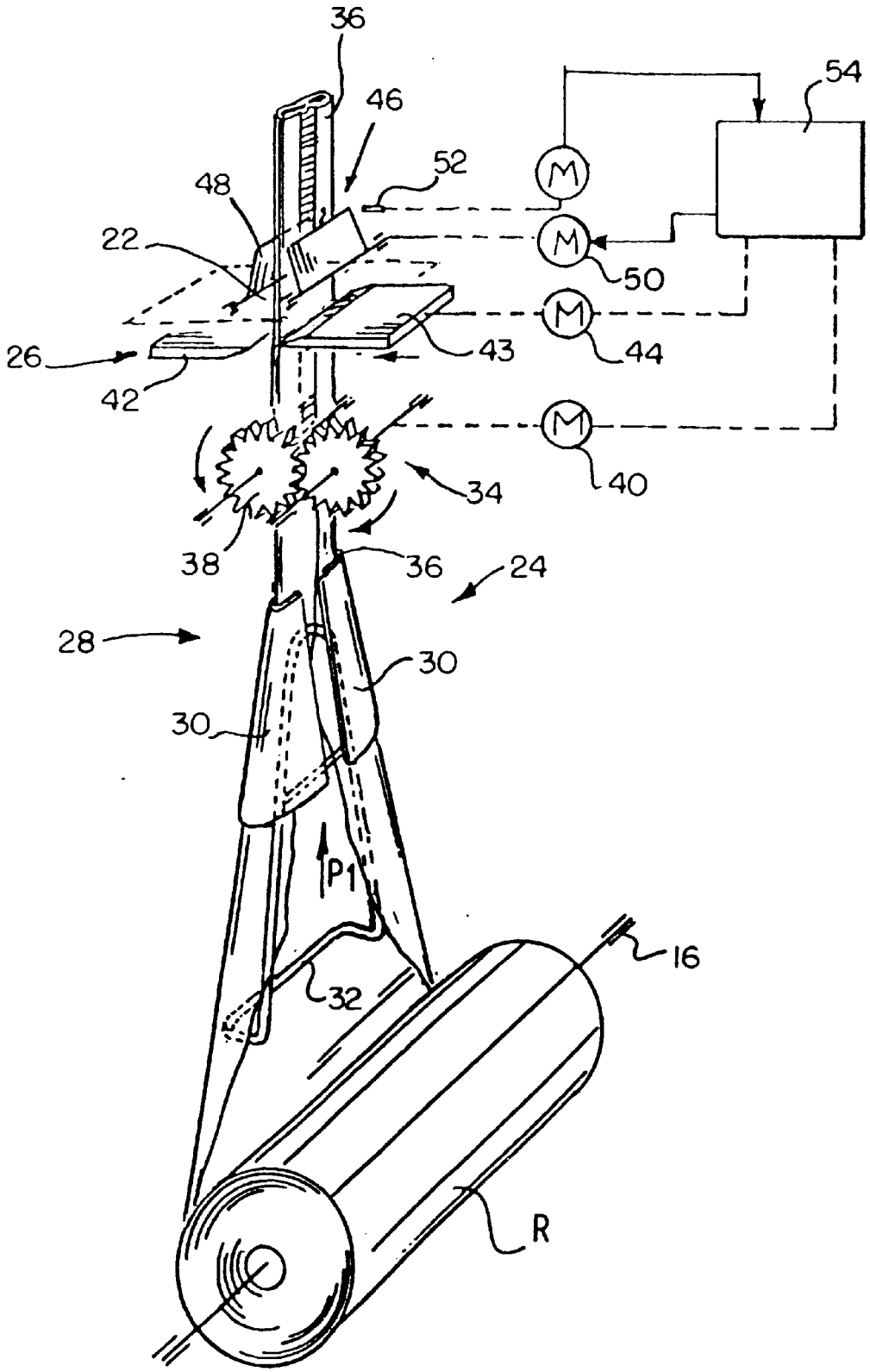
FIG. 2 is a schematic view of the different components within the housing of the device.

FIG. 2 shows the different assemblies which cooperate to produce the cushioning product. In this figure the housing 14 of FIG. 1 is omitted to reveal the assemblies within the housing. As can be seen the machine 10 further includes a conversion assembly 24 for converting the strip of paper 18 received from the roll R into a continuous strip of cushioning product and a cutting assembly 26 which cuts the continuous strip of cushioning product into cut pads of a desired length. The conversion assembly 24 includes a forming assembly 28 comprised of chute 30 with a forming frame 32 partially disposed therewithin, and a gear assembly 34 which coacts with the forming assembly to convert the sheet-like material into a continuous strip of cushioning product.

During the conversion process, the strip of paper 18 is fed through the forming assembly 28 wherein the lateral edges of the paper are caused to roll inwardly, such as in a spiralling fashion, to form a continuous strip 36 having lateral pillow-like portions and a thin central band. Through the forming process the thickness of the strip of paper is tripled. When triple-ply paper is used as the stock material, nine layers then lie on one another.

The gear assembly 34 includes a pair of enmeshed, toothed gears 38 forming a nip through which the strip of cushioning material 36 is fed and which coins the material as a result of the deformation by the teeth of the gears. It is also possible to use these toothed gears 38 to pull the strip of material upward in the direction of arrow P1. The gear assembly 34 is driven by the gear motor 40.

The cutting assembly 26 arranged above or downstream of the gear assembly 34 preferably includes a fixed blade 42 and a movable blade 43 which is driven by a cut motor 44.

Finally, an access assembly 46 in the form of two flaps, door or valves 48 is arranged above or downstream of cutting assembly 26, with the valves proximate the exit opening 22 of housing 14. The valves 48 serve to permit or to substantially close off access to the cutting zone of the cutting assembly 26 through the opening 22 depending upon whether the valves are in a relative open or closed position. The valves 48 have a trailing position relative to the transporting direction P1 and leave a determined opening between the distal edges thereof when in a closed condition such that the formed paper strip 36 can be pulled out therebetween after being cut into a pad of a desired length by the cutting assembly 26. The position of the valves 48 is determined by a valve motor or similar motive means 50 and sensed by a sensor 52 which transmits a signal indicating the position of the valves to a control circuit, which is shown schematically by block 54 in FIG. 2. The control circuit 54 also serves to control the gear motor 40, the cut motor 44 and the valve motor 50.

Figure 3:
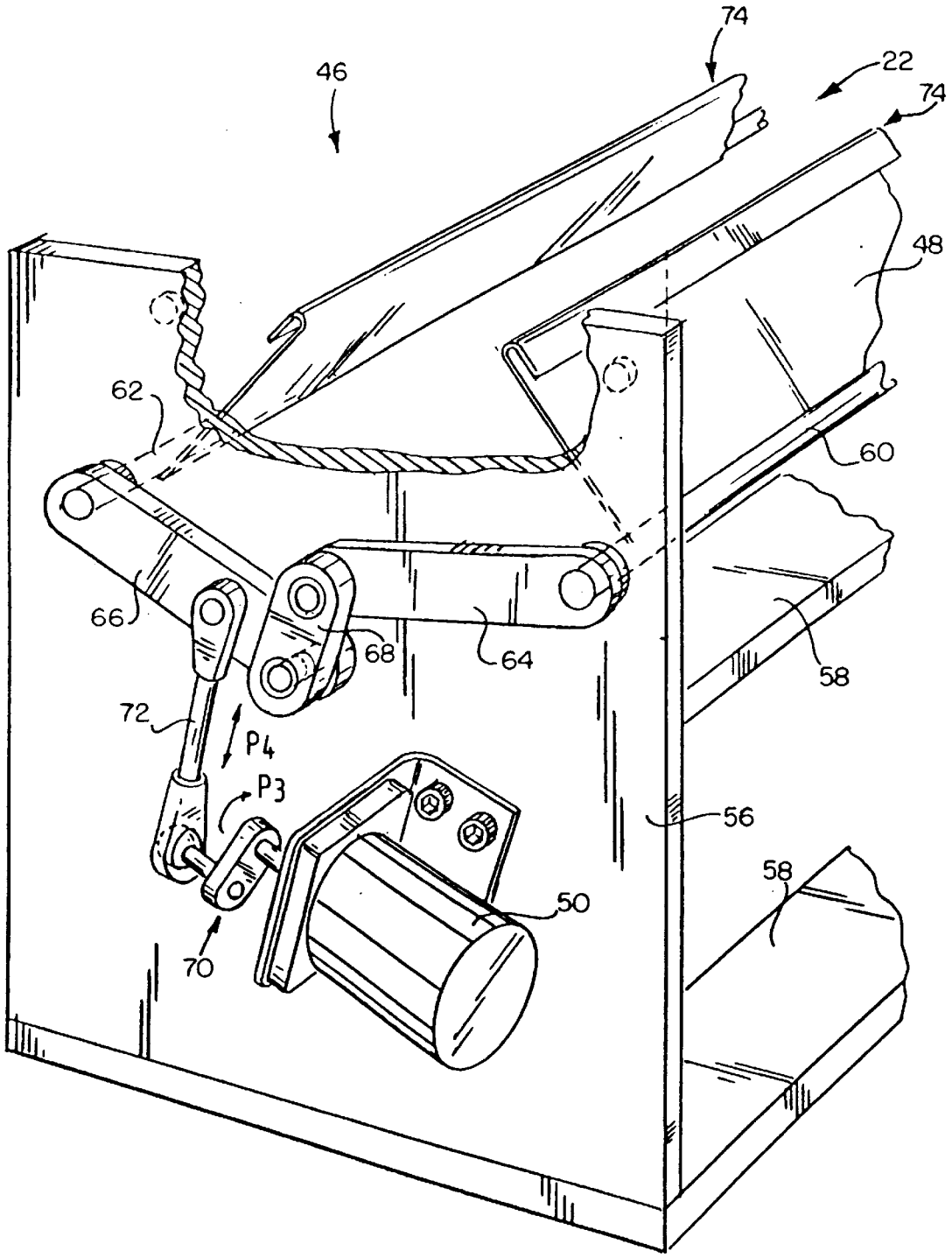
FIGS. 3 and 4 show in each case a perspective view of two embodiments of the access assembly according to the invention.

As shown in FIG. 3, the access assembly 46 includes a front plate 56 and a parallel rear plate (not shown) which are mutually connected by spacer elements 58. The valves 48 swivel in the exit opening 22 on swivel shafts 60, 62 which have a parallel orientation. The swivel shafts 60, 62 are rotatably mounted in the plates with the end of the swivel shafts mounted in the front plate 56 protruding through the front plate in order to enable connection in each case to arms 64, 66, respectively. The other ends of the arms 64, 66 are mutually connected by an intermediate arm 68. Arranged on front plate 56 is the valve motor 50 which is connected pivotally to the arm 66 via a crank 70 and a crank arm 72. The valve motor 50 is energized and rotates in one direction so that the crank 70 turns, for instance, in the direction of arrow P3. This provides a reciprocating movement of crank arm 72 in the direction of arrow P4. The respective arms 64, 66 are thus caused to rotate about the axes of the swivel shafts 60, 62, respectively, thereby rotating the swivel shafts and causing the valves 48 mounted to the swivel shafts to be moved apart to a greater or lesser degree such that they are moved from a closed position, wherein the distal edges 74 of the valves lie substantially adjacent each other, to an open position, wherein the valves lie practically parallel to each other with their distal edges substantially separated.

Figure 4:
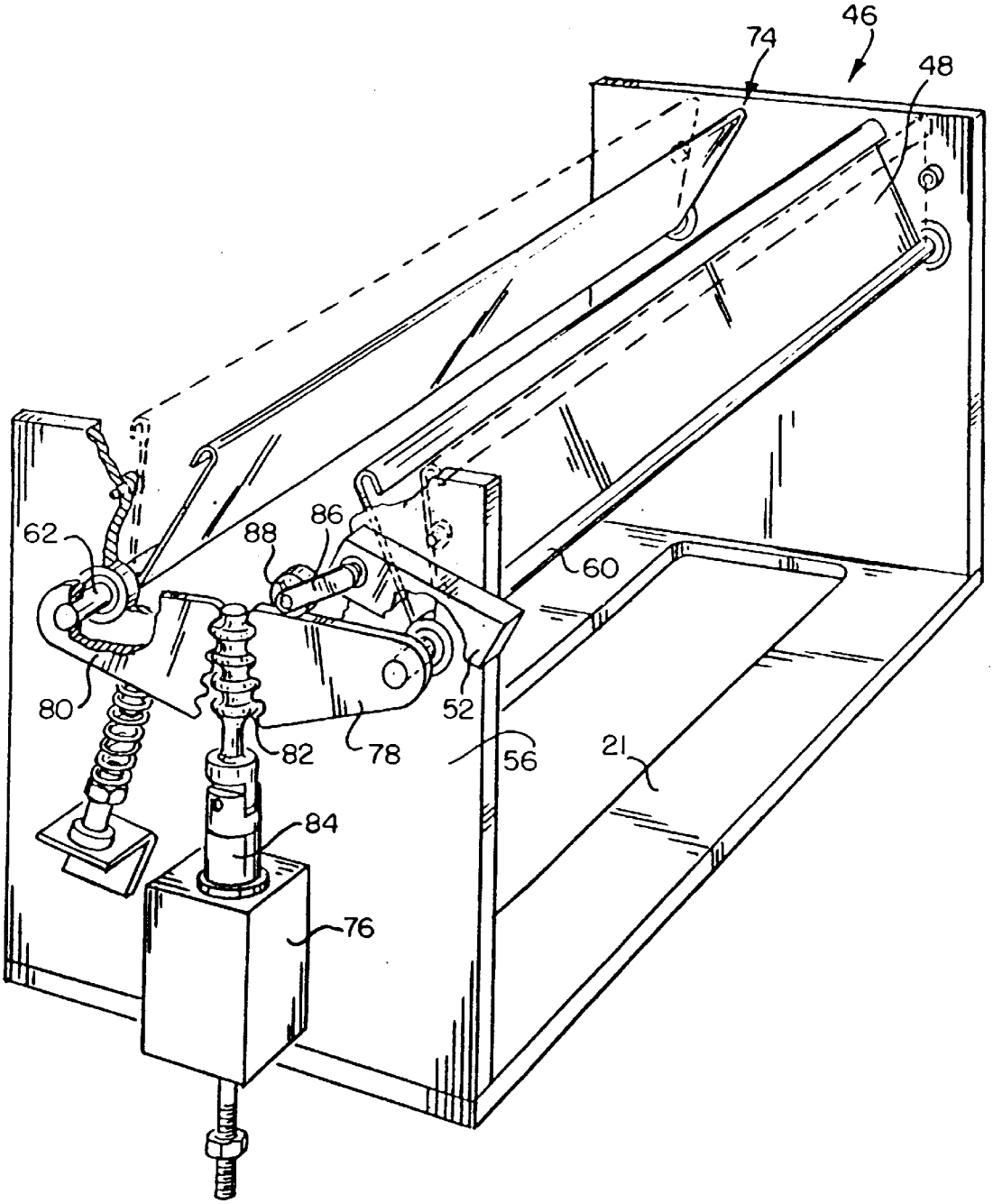

FIG. 4 shows an alternate embodiment of the drive mechanism for the access assembly 46. Arranged on front plate 56 is a solenoid 76 which serves as motive means for driving the arms 78, 80 connected to the swivel shafts 60, 62. The arms 78, 80 are embodied here as gear segments, the toothing of which is in engagement with a gear rack 82 which is joined to the solenoid pin 84. It will be apparent from FIG. 4 that by energizing the solenoid 76 the pin 84 is pulled inwardly, carrying with it the gear rack 82, which rotates the two gear segments 78 and 80 and therewith the valves 48 of the access assembly 46.

In this embodiment the sensor 52 is embodied as microswitch, the arm 86 of which senses the position of the gear segment 78 via a roller 88 and thereby determines whether the valves 48 are in an open or closed condition. The sensor 52 generates a signal which is transmitted to the control circuit 54 in FIG. 2 which, when the access assembly S assembly 46 is in its open position, renders inoperative the energizing of cut motor 44 of cutting assembly 26. The gear motor 40 powering the gear assembly 34 for through-feed of the strip of paper 36 can however be energized so that a determined strip can be discharged through the opening. Once the desired length of paper has been fed through the machine 10, the control circuit 54 commands the gear motor to stop and energizes the valve motor 50 or solenoid 76 to close the valves 48 of the access assembly 46. Once the sensor 52 has sensed that the valves 48 are in a closed condition and this information has been relayed to the control circuit 54, the control circuit energizes the cut motor 44 to cause the blades 42, 43 of the cutting assembly 26 to cut the strip of paper 36 to result in the appropriately sized length of cushioning product. Thereafter the user can pull the cut pad outward between the valves 48 to remove it from the machine for packaging a given item.

After the cutting operation is complete, e.g., the control circuit 54 has caused the blades 42, 43 to retract, the valve motor 50 can be energized to open the access assembly and the feed motor 40 can be started for renewed feed of the strip of paper 36 through the machine 10. It is noted that when closing of the valves 48 of the access assembly is prevented, for instance because of the presence of a foreign object between them, the control circuit 54 will not energize the cut motor 44 despite the possibility that the valve motor 50 for the access assembly has energized to close the valves. The interaction of the access assembly and the cutting assembly and gear assembly as controlled by the control circuit may be based on sensing of the states of the assemblies or based on a time dependant operation wherein the control circuit commands the respective assemblies to perform their operations based on a time sequence, or a combination of these control methods.

The invention is not limited to the above described embodiments. Many modifications of the invention given the preceding description will become apparent, all such modifications being within the scope of the invention. As an example, the sensor 52 may embodied as a different sensor or as multiple sensors, such as separate sensors to determine if the access assembly is in an open position or a closed position. Moreover, opening or closing of the valves may be actuated by a variety of different actuation means. For example, the crank and linkage mechanism of FIG. 3 could be combined with a pair of enmeshed partial gears such as illustrated in FIG. 4, but without the intermediate gear rack, to effectuate control of the valves.

I claim:

1. A machine (10) for converting a sheet-like stock material (18) into a cushioning product of a desired length, said machine comprising:

a frame (12) having a housing (14) with an exit pathway (22);

a conversion assembly (24), mounted to the frame (12), which converts the sheet-like stock material (19) into a dunnage strip (36) and which feeds the dunnage strip (36) into the exit pathway (22) for passage out of the housing;

a cutting assembly (26), positioned at an upstream end of the exit pathway (22), which cuts the dunnage strip (36) to produce the cushioning product of the desired length;

wherein:

the machine (10) includes an access assembly (46) movable between an open condition which permits the cushioning product to be fed through the exit pathway and a closed condition which at least partially blocks the exit pathway to restrict access to the cutting assembly (26) through the exit pathway (22); and the machine (10) includes a control assembly (54) which allows operation of the conversion assembly (24) when the access assembly (46) is in the open condition and which prevents operation of the cutting assembly (26) unless the access assembly (46) is in the closed condition.

2. A machine (10) as set forth in claim 1, wherein the control assembly (54) includes a sensor (52) for determining whether the access assembly (46) is in the closed condition and wherein the control assembly (54) only allows operation of the cutting assembly (26) when the sensor (52) determines that the access assembly (46) is in the closed condition.

3. A machine (10) as set forth in claim 2, wherein the control assembly (54) moves the access assembly (46) to the closed condition upon deactivation of the conversion assembly (24).

4. A machine (10) as set forth in claim 3 wherein the control assembly (54) moves the access assembly (46) to the open condition upon deactivation of the cutting assembly (26).

5. A machine (10) as set forth in claim 4, wherein the control assembly (54) activates the conversion assembly (24) upon deactivation of the cutting assembly (26).

6. A machine (10) as set forth in claim 1, wherein the access assembly (46) includes at least one door (48) which moves between an open position and a closed position.

7. A machine (10) as set forth in claim 6, wherein the door (48) pivots between an open position and a closed position.

8. A machine (10) as set forth in claim 1, wherein the access assembly (46) includes two doors (48) which move between an open position at which their distal edges (74) are substantially separated and a closed condition at which their distal edges (74) are substantially adjacent to each other.

9. A machine (10) as set forth in claim 8, wherein the doors (48) pivot between the open position and the closed condition.

10. A machine (10) as set forth in claim 1, wherein the conversion assembly (24) also includes a forming assembly (28) which forms the dunnage strip (36) from the sheet-like stock material (18) and a feed assembly (34) which feeds the dunnage strip (36) into the exit pathway (22).

11. A machine (10) as set forth in claim 10, wherein the feed assembly (34) is a pulling assembly which is positioned downstream of the forming assembly (28) and which pulls the stock material (18) through the forming assembly (28).

12. A machine (10) as set forth in claim 11, wherein the pulling assembly (34) is a pulling/connecting assembly which connects the dunnage step (36).

13. A machine (10) as set forth in claim 12, wherein the pulling/connecting assembly (34) comprises a pair of gears (38) which coin the dunnage strip (36) as it passed therethrough.

14. A machine (10) as set forth in claim 10, wherein the conversion assembly (24) further includes a stock supply assembly, positioned upstream of the forming assembly (28), which supplies the sheet-like stock material (18) to the forming assembly (28).

15. A machine as set forth in claim 1, wherein the control assembly includes a motive device which moves the access assembly between the open and closed conditions and a control circuit which controls the motive device.

* * * * *